US006861987B2

(12) United States Patent
Chang et al.

(10) Patent No.: US 6,861,987 B2
(45) Date of Patent: Mar. 1, 2005

(54) BILAYER MICROSTRIP REFLECTOR ANTENNA

(75) Inventors: The-Nan Chang, Taipei (TW); Yu-Cheng Wei, Taipei (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/429,779

(22) Filed: May 6, 2003

(65) Prior Publication Data

US 2004/0140943 A1 Jul. 22, 2004

(30) Foreign Application Priority Data

Jan. 17, 2003 (TW) ..... 92101027 A

(51) Int. Cl.[7] ..... H01Q 1/38; H01Q 19/10

(52) U.S. Cl. ..... 343/700 MS; 343/754; 343/755

(58) Field of Search ..... 343/700 MS, 754, 343/755

(56) References Cited

U.S. PATENT DOCUMENTS 4,684,952 A * 8/1987 Munson et al. ..... 343/700 MS
6,441,787 B1 * 8/2002 Richards et al. ..... 343/700 MS

* cited by examiner

*Primary Examiner*—Michael C. Wimer
(74) *Attorney, Agent, or Firm*—Bacon & Thomas

(57) ABSTRACT

A bilayer microstrip reflector antenna is disclosed to include a first dielectric layer, the first dielectric layer having antenna units and phase-delay circuit units overlapped on antenna units, and a second dielectric layer abutting against the first dielectric layer. A better gain-bandwidth is obtained by adjusting the overlapping distance of the antenna units and phase-delay circuit units, side length of antenna units and the dielectric constant and thickness of the two dielectric layers. Surface wave phenomenon is reduced by means of selecting a relatively lower dielectric constant. A satisfactory grounding effect is obtained to reduce radiation from phase-delay circuit units by lowering the second dielectric layer toward the ground.

7 Claims, 5 Drawing Sheets

BILAYER MICROSTRIP REFLECTOR ANTENNA

BACKGROUND OF THE INVENTION

1. Field of the Invention

The present invention relates to antennas and, more particularly, to a planar bilayer microstrip reflector antenna that increases the antenna gain-bandwidth.

2. Description of Related Art

In comparison with parabolic reflector antennas, micros trip reflector antennas employ relatively new technology. A parabolic reflector antenna has a curved surface. A microstrip reflector antenna can be made having a planar surface. Further, a microstrip reflector antenna can achieve the concentration of antenna beam in a particular direction by means of the application of one of several methods.

However, conventional microstrip reflector antennas that achieve concentration of antenna beam by different methods have the common problem of narrow gain-bandwidth. Methods of improving the problem of narrow gain-bandwidth are reported in specific issues. However, these reports are commonly of a single layer design formed of a single printed circuit board (see FIG. 7). Taiwan Patent Publication No. 242711 discloses a single dielectric layer microstrip reflector antenna. Improving the bandwidth of this design of single dielectric layer microstrip reflector antenna can be achieved only by increasing the thickness of the dielectric layer. −3 dB gain-bandwidth can be achieved to 7.2% for this design of antenna. Increasing the thickness of the dielectric layer may cause the so-called surface wave phenomenon, thereby reducing antenna efficiency accompanying with the problem of high radiation level from delay circuit.

Therefore, it is desirable to provide a bilayer microstrip reflector antenna that eliminates the aforesaid drawbacks.

SUMMARY OF THE INVENTION

It is the main object of the present invention to provide a bilayer microstrip reflector antenna, which greatly improves antenna gain-bandwidth, eliminate interferences between antennas, and reducing radiation level from phase-delay circuit.

To achieve this and other objects of the present invention, the bilayer microstrip reflector antenna comprises a bilayer printed circuit board used with a horn antenna. The bilayer printed circuit board comprises a first dielectric layer and a second dielectric layer abutted against the first dielectric layer. The first dielectric layer has a thickness, a dielectric constant, a plurality of antenna units disposed on one face, and a plurality of phase-delay circuit units disposed on the other face respectively corresponding to the antenna units, wherein the phase-delay circuit units each overlapping the corresponding antenna unit a distance. The second dielectric layer has a thickness and a dielectric constant. Therefore, a better gain-bandwidth can be obtained by means of adjusting the overlapping distance of the antenna units and the phase-delay circuit units, side length of the antenna units and the dielectric constant and thickness of the two dielectric layers. Surface wave phenomenon can be reduced by means of selecting a relatively lower dielectric constant. A satisfactory grounding effect can be obtained to reduce radiation from phase-delay circuit units by lowering the second dielectric layer toward the ground.

Because the second dielectric layer is abutted against the first dielectric layer, the phase-delay circuit units or antenna units can be sandwiched between the first dielectric layer and the second dielectric layer. Further, the second dielectric layer can be the air. Using the air to form the desired second dielectric layer abutting against the first dielectric layer enables the invention to be used in a place, for example, the roof of a motor vehicle that is disposed in contact with the external world.

Further, the antenna units each can be made having a rhombic shape, square shape, rectangular shape, skew rhombic shape, circular shape, or any of a variety of shapes. The phase-delay circuit units each can be made having a rectangular shape and a width, or a curved shape. The antenna units and the phase-delay circuits can be formed in the surface of the first dielectric layer by etching.

DETAILED DESCRIPTION OF THE PREFERRED EMBODIMENT

Figure 1:
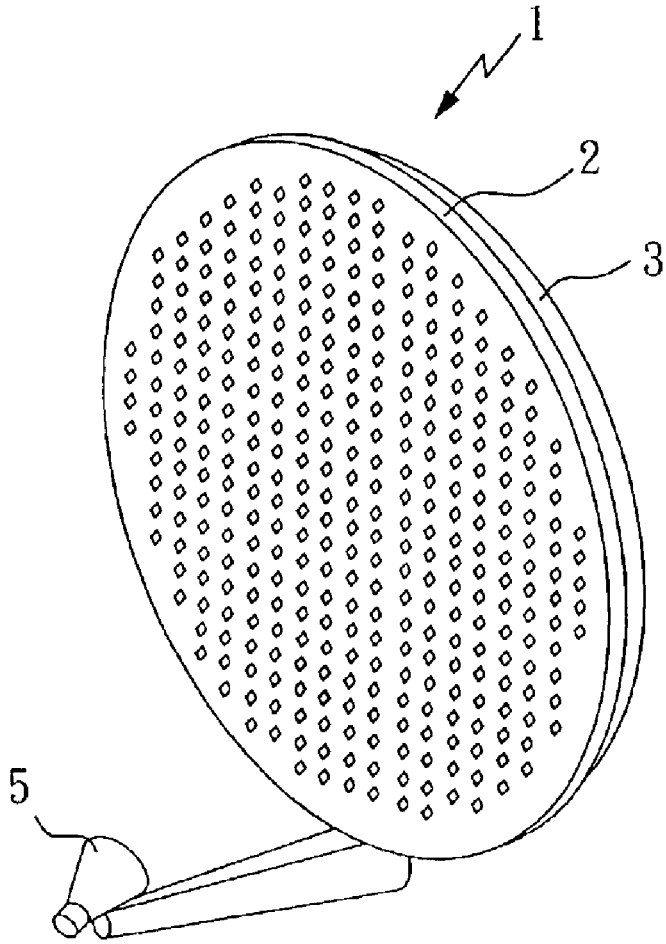
FIG. 1 illustrates a circular bilayer microstrip reflector antenna constructed according to the present invention.
Figure 2A:
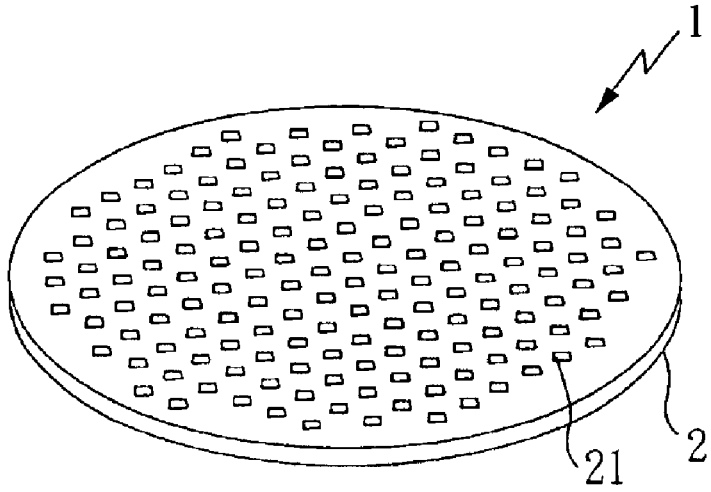
FIG. 2*a* is an elevational view of a part of the present invention, showing the arrangement of the antenna units in the first dielectric layer.
Figure 2B:
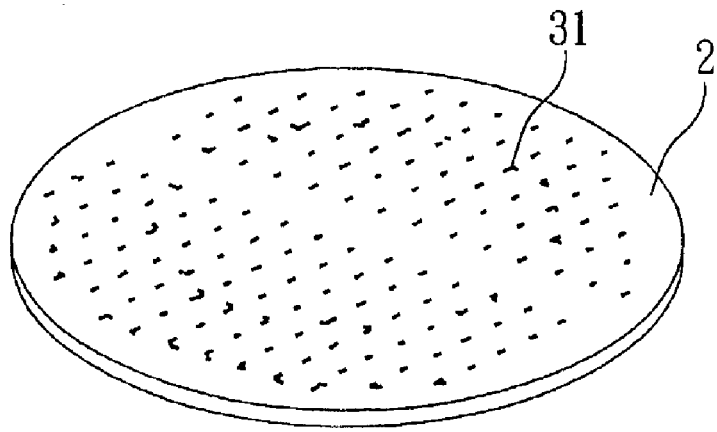
FIG. 2*b* is an elevational view of a part of the present invention, showing the arrangement of the phase-delay circuit units in the first dielectric layer.
Figure 3:
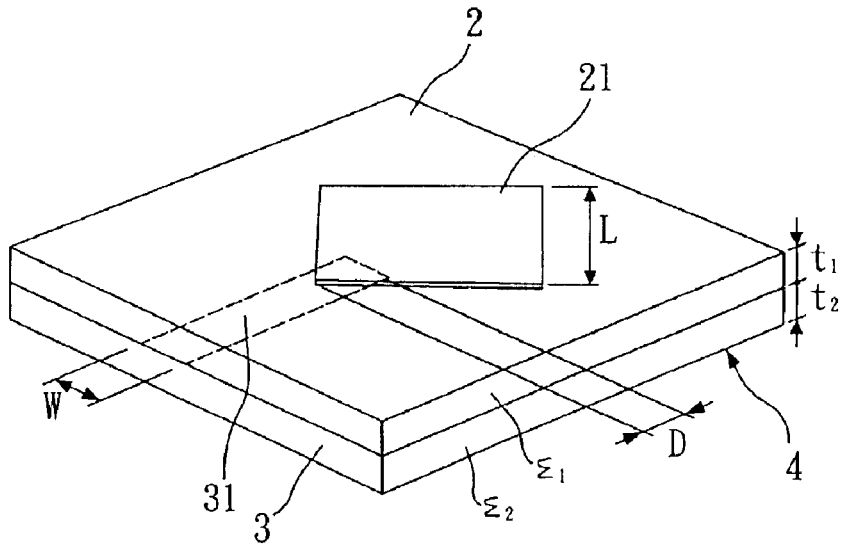
FIG. 3 is a schematic drawing showing the detailed structure of the bilayer microstrip reflector antenna.

Referring to FIG. 1, a circular bilayer microstrip reflector antenna 1 is shown comprised of a first dielectric layer 2, a second dielectric layer 3 abutting against the first dielectric layer 2, and a horn antenna 5. As illustrated in FIGS. 2*a* and 2*b*, the aforesaid first dielectric layer 2 comprises a plurality of antenna units 21 on one face and a plurality of phase-delay circuit units 31 on the other face. The phase-delay circuit units 31 are sandwiched between the first dielectric layer 2 and the second dielectric layer 3. Referring to FIG. 3, the first dielectric layer 2 has a thickness $t_1$ and a dielectric constant $\epsilon_1$. The second dielectric layer 3 that abuts to the first electric layer 2, has a thickness $t_2$ and a dielectric constant $\epsilon_2$. According to this embodiment, the antenna units 21 in the first dielectric layer 2 are rhombic, having a side length L; the phase-delay circuit units 31 are rectangular, having a width W. The phase-delay circuit units 31 each overlapping the corresponding antenna units 21 a distance D. Further, a grounding surface 4 is formed in the second dielectric layer 3. The antenna units 21 and the phase delay circuit units 31 are formed in the surface of the first dielectric layer 2 by etching.

Figure 4:
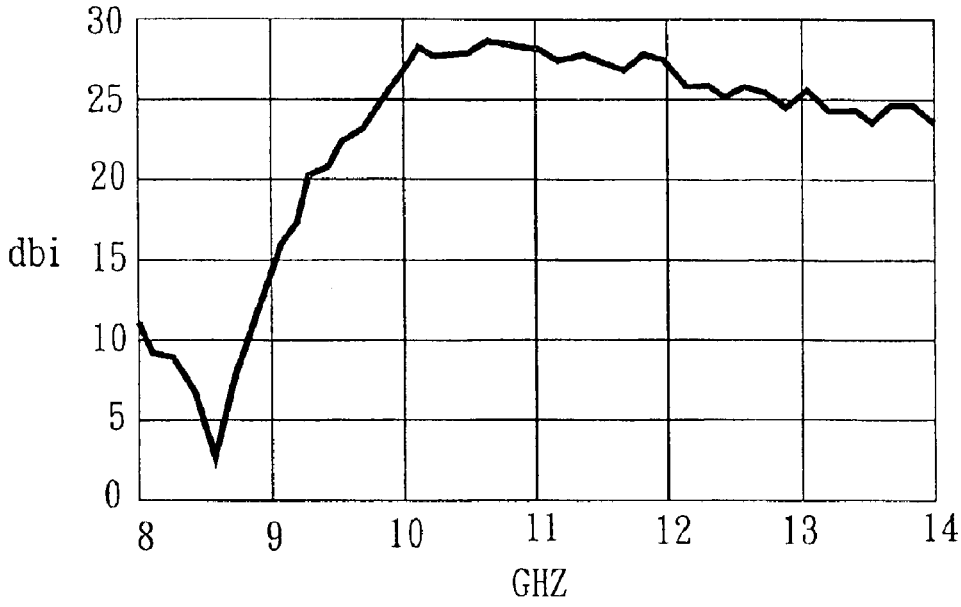
FIG. 4 is a gain-bandwidth vs frequency curve obtained from a test subject to the present invention.
Figure 5:
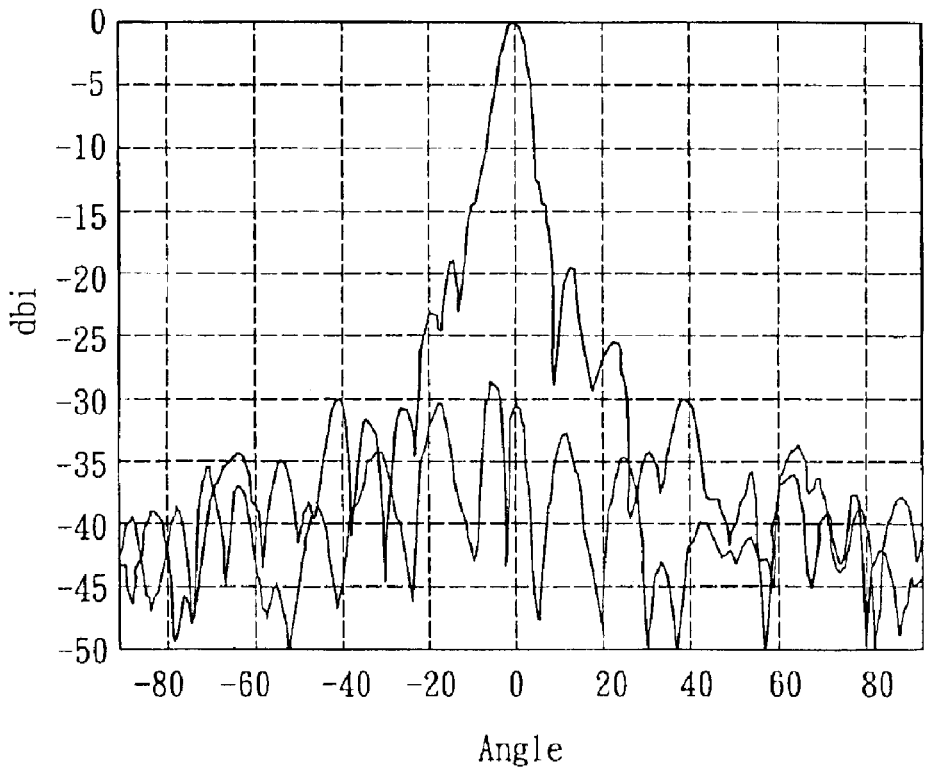
FIG. 5 is an antenna field gain curve obtained at frequency 10.4 GHz according to the present invention.

Therefore, by means of adjusting every side length L of the antenna 5 units 21 of the aforesaid first dielectric layer 2 and the dielectric constant $\epsilon_1$ and $\epsilon_2$ and thickness $t_1$ and $t_2$ of the first dielectric layer 2 and second dielectric layer 3, a better bandwidth is obtained. Further, the surface wave phenomenon due to structural thickness increase as seen in the prior art designs can be minimized by means of selecting a lower dielectric constant $\epsilon_1$ for the first dielectric layer 2. Further, because the invention adopts a bilayer structure formed of the aforesaid first dielectric layer 2 and second dielectric layer 3, a satisfactory grounding effect is achieved to reduce radiation from the phase-delay circuit units 31 by means of lowering the grounding surface 4 of the second dielectric layer 3 toward the ground. FIG. 4 is a gain-bandwidth vs frequency curve obtained from a test result subject to the present invention. The test was made under the conditions: the thickness $t_1$ and dielectric constant $\epsilon_1$ of the first dielectric layer 2 are 0.4 mm and 4.6 respectively; the thickness $t_2$ and dielectric constant $\epsilon_2$ of the second dielectric layer 3 are 1.6 mm and 4.6 respectively; the antenna units 21 are rhombic, having the side length L of 5 mm; the width W of the phase-delay circuit units 31 is 1.5 mm; the overlapping distance D of the phase-delay circuit units 31 and the antenna units 21 is 2.5 mm. The curve of FIG. 4 shows that under the aforesaid parameters, the maximum gain-bandwidth occurs at frequency about 11 GHZ and the gain is 29 dbi. FIG. 4 also shows the variation of gain reaches 22% under 3 dbi, much better than 7.2% of the prior art designs. Further, by means of selecting a lower dielectric constant $\epsilon_1$ for the first dielectric layer 2, the surface wave phenomenon is greatly reduced. The design of the grounding face 4 of the second dielectric layer 3 that is disposed relatively closer to the ground effectively reduces radiation from the phase-delay circuit units 31. FIG. 5 is an antenna field gain curve obtained under the aforesaid parameters at frequency 10.4 GHz, in which the transverse axis indicates the angle with zero degree set as the beam focusing direction; the longitudinal axis indicates the gain value. As curve tells, the present invention has a significant narrow beam focusing capability. According to the present invention, the beam at 3 db is within 3°, and the side lobe can be about 20 db lower than the main beam.

Figure 6:
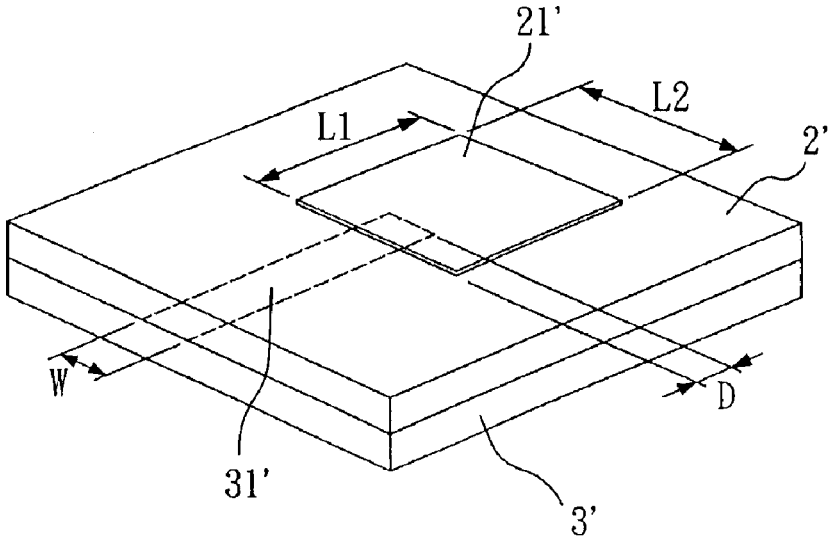
FIG. 6 is a schematic drawing showing the detailed structure of an alternate form of the bilayer micros trip reflector antenna.
Figure 7:
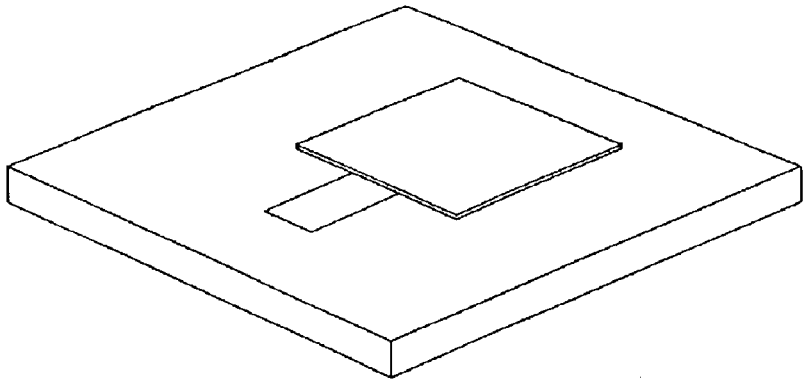
FIG. 7 (PRIOR ART)
FIG. 7 is a schematic drawing showing the structure of a single-layer micros trip reflector antenna according to the prior art.

FIG. 6 is a schematic structural view of an alternate form of the bilker structure of the present invention. According to this embodiment, the first dielectric layer 2' and the second dielectric layer 3' are abutted against each other with phase-delay circuit units 31' sandwiched in therebetween. The only difference of this alternate form is the rectangular shape of the antenna units 21' in the first dielectric layer 2'. According to this embodiment, the rectangular antenna units 21' have side length L1 and side length L2. This embodiment also achieves the effects of the aforesaid first embodiment of the present invention. Therefore, the antenna units 21' can be made having a rhombic shape, square shape, rectangular shape, skew rhombic shape, circular shape, or any of a variety of shapes.

The second dielectric layer 3 can use the air to form with the first dielectric layer 2 a bilayer structure. The dielectric constant of the air can be used as an adjustment parameter so as to achieve the aforesaid effects. A bilayer microstrip reflector antenna made according to this design can be installed in the roof of a motor vehicle to receive signal.

Although the present invention has been explained in relation to its preferred embodiments, it is to be understood that many other possible modifications and variations can be made without departing from the spirit and scope of the invention as hereinafter claimed.

What is claimed is:

1. A bilayer microstrip reflector antenna used with a horn antenna, comprising:

a first dielectric layer, said first dielectric layer having a thickness, a dielectric constant, a first face, a second face opposite to said first face, a plurality of antenna units disposed on said first face thereof, and a plurality of phase-delay circuit units disposed on said second face respectively corresponding to said antenna units, and respectively spaced from wherein said phase-delay circuit units each overlapping said corresponding antenna units at a distance to thus form a respective corner-feed coupling part as a radiation element and further obtain required impedance match; and a second dielectric layer abutting against said first dielectric layer, said second dielectric layer having a thickness and a dielectric constant.

2. The bilayer microstrip reflector antenna as claimed in claim 1, wherein said phase-delay circuit units are respectively sandwiched between said first dielectric layer and said second dielectric layer.

3. The bilayer microstrip reflector antenna as claimed in claim 1, wherein said antenna units each have a rhombic shape with a side length, thereby forming the respective corner-feed coupling part.

4. The bilayer microstrip reflector antenna as claimed in claim 1, wherein said phase-delay circuit units each have a rectangular shape with a width, thereby forming the respective corner-feed coupling part.

5. The bilayer microstrip reflector antenna as claimed in claim 1, wherein said antenna units and said phase-delay circuit units are formed by etching.

6. The bilayer microstrip reflector antenna as claimed in claim 3, wherein the side length of the antenna units, the distance where the antenna units overlap the phase-delay circuit units, the dielectric constant and thickness of the two dielectric layers are adjusted to produce a desired gain-bandwidth.

7. The bilayer microstrip reflector antenna as claimed in claim 4, wherein the width of the antenna units, the distance where the antenna units overlap the phase-delay circuit units, the dielectric constant and thickness of the two dielectric layers are adjusted to produce a desired gain-bandwidth.

* * * * *